US010490884B2

(12) United States Patent
Kuang et al.

(10) Patent No.: US 10,490,884 B2
(45) Date of Patent: Nov. 26, 2019

(54) METAL COVER AND ELECTRONIC DEVICE

(71) Applicant: Beijing Xiaomi Mobile Software Co., Ltd., Haidian District, Beijing (CN)

(72) Inventors: Wei Kuang, Beijing (CN); Wendong Liu, Beijing (CN); Xiaohui Pi, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 281 days.

(21) Appl. No.: 15/653,555

(22) Filed: Jul. 19, 2017

(65) Prior Publication Data

US 2018/0026352 A1 Jan. 25, 2018

(30) Foreign Application Priority Data

Jul. 21, 2016 (WO) ..... PCT/CN2016/090860

(51) Int. Cl.
*H01Q 1/50* (2006.01)
*H01Q 1/24* (2006.01)

(52) U.S. Cl.
CPC ..... *H01Q 1/243* (2013.01); *H01Q 1/50* (2013.01)

(58) Field of Classification Search
CPC ..... H01Q 1/24; H01Q 1/50; H01Q 9/42
USPC ..... 343/702
See application file for complete search history.

(56) References Cited

U.S. PATENT DOCUMENTS

2008/0165071 A1* 7/2008 Chiang ..... H01Q 1/38 343/767
2015/0057054 A1* 2/2015 Su ..... H01Q 1/243 455/575.7

FOREIGN PATENT DOCUMENTS

| | | | |
|---|---|---|---|
| CN | 103390796 | A | 11/2013 |
| CN | 104505589 | A | 4/2015 |
| CN | 105244598 | A | 1/2016 |
| CN | 105762512 | A | 7/2016 |

OTHER PUBLICATIONS

Office Action in EP application No. 17181406.4, dated Dec. 21, 2018.
International Search Report in PCT application No. PCT/CN2016/090860, dated Apr. 17, 2017.
English Translation of the Written Opinion of the International Searching Authority in PCT application No. PCT/CN2016/090860.
Extended European Search Report for European Application 17181406.4, dated Nov. 8, 2017.

* cited by examiner

*Primary Examiner* — Andrea Lindgren Baltzell
(74) *Attorney, Agent, or Firm* — Jun He Law Offices P.C.; James J. Zhu

(57) ABSTRACT

A metal cover and an electronic device are provided. The metal cover includes a metal body comprising at least one ground point; an antenna radiator electrically connected to the at least one ground point; and a gap formed between the metal body and the antenna radiator.

20 Claims, 4 Drawing Sheets

METAL COVER AND ELECTRONIC DEVICE

CROSS-REFERENCE TO RELATED APPLICATIONS

This application is based upon and claims priority to International Application No PCT/CN2016/090860, filed on Jul. 21, 2016, the entire contents of which are incorporated herein by reference.

TECHNICAL FIELD

The present disclosure relates to the field of terminal technology, and more particularly to a metal cover and an electronic device.

BACKGROUND

Due to good metal texture, hand feeling, beautiful looking and cost advantages, all-metal covers are used more and more in smartphones. All-metal cover will shield signals received or radiated by an antenna, while a wider and wider signal bandwidth is needed to be supported by a smartphone for wireless communication, and there is also a need for openings in an antenna area of the smartphone to contain a Universal Serial Bus (USB) interface, a fingerprint identification sensor and main keys, etc., and therefore a large area of metal gap-crossing will exist in a metal cover. Since the all-metal cover is very thin, a distance between the all-metal cover and the gap-crossing is very small, strong coupling is formed between the all-metal cover and the gap-crossing, and an equivalent parasitic capacitor appears, which may cause a reduction of a signal radiation of the antenna of the smartphone in some frequency bands.

SUMMARY

Embodiments of the present disclosure provide a metal cover and an electronic device.

According to a first aspect of embodiments of the present disclosure, a metal cover is provided. The metal cover includes a metal body having at least one ground point; an antenna radiator electrically connected to the at least one ground point; and a gap formed between the metal body and the antenna radiator.

According to a second aspect of the embodiments of the present disclosure, an electronic device is provided. The electronic device includes: a processor; a memory for storing instructions executable by the processor; and a metal cover. The metal cover includes a metal body having at least one ground point; an antenna radiator electrically connected to the at least one ground point; and a gap formed between the metal body and the antenna radiator.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

Figure 1:
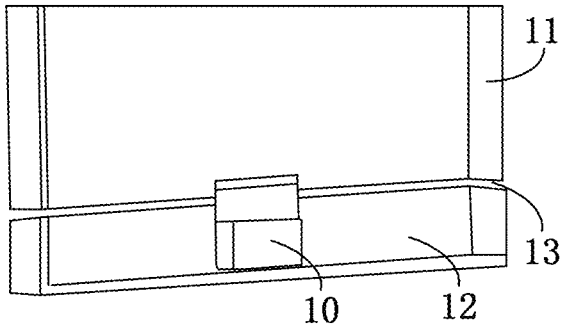
FIG. 1 is a perspective view of a metal cover according to an example embodiment.

FIG. 1 is a perspective view of a metal cover according to an example embodiment. The metal cover can be used in an electronic device (for example, smartphone, a panel computer, etc.) as a housing of the electronic device. As shown in FIG. 1, the metal cover includes a metal body 11 and an antenna radiator 12, and a gap 13 is formed between the metal body 11 and the antenna radiator 12. There are openings for containing a USB interface 10, a fingerprint identification sensor (not shown) and an icon of the smartphone (not shown) opened in the area where the antenna radiator 12 is located. Taking the USB interface 10 as an example for illustrating, when the USB interface 10 is contained in the opening, the USB interface 10 will form a gap-crossing at the gap 13, When the distance from the gap 13 in the thickness direction of the electronic device is less than a predetermined distance (the predetermined distance can be determined by the thickness of the electronic device), the metal at the gap-crossing forms a strong coupling with the gap 13, and thus a parasitic capacitance is formed, which may reduce the signal radiation of the antenna radiator 12 at some frequency bands. Descriptions of the parasitic capacitance may be found in the following embodiments, and thus will not be elaborated here.

Figure 2A:
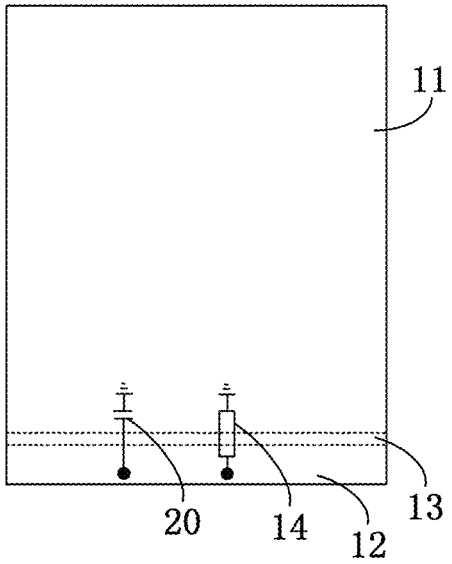
FIG. 2A is a schematic diagram showing a structure of a metal cover according to an example embodiment.
Figure 2B:
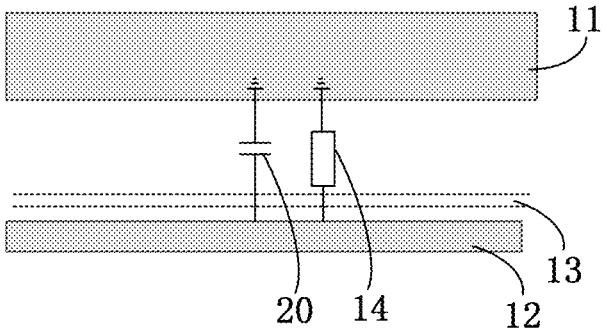
FIG. 2B is a schematic diagram showing an equivalent circuit of a metal cover according to an example embodiment.

FIG. 2A is a schematic diagram showing a structure of a metal cover according to an example embodiment, and FIG.

2B is a schematic diagram showing an equivalent circuit of a metal cover according to an example embodiment. As shown in FIG. 2A, there is a gap 13 formed between the metal body 11 and the antenna radiator 12, and there is a first energy storage element 14 electrically connected between the metal body 11 and the antenna radiator 12. The metal body 11 may be regarded as a ground end of the first energy storage element 14, and the antenna radiator 12 may be regarded as a power supply end of the first energy storage element 14.

when the distance between the metal of the USB interface 10 at the gap-crossing and the gap 13 in the thickness direction of the electronic device is less than a predetermined distance (the predetermined distance can be determined by the thickness of the electronic device), the gap-crossing is located at the joint of the USB interface 10 and the gap 13, there exists a strong coupling between the metal of the USB interface 10 at the gap-crossing and the gap 13, and an equivalent parasitic capacitor 20 is formed. With regard to high-frequency signals, the equivalent parasitic capacitor 20 is equivalently grounded at the gap-crossing of the USB interface 10, which may cause the antenna radiator 12 unable to radiate signals normally at some frequency bands.

In this embodiment, with the parallel connection of the first energy storage element 14 and the parasitic capacitor 20, the first energy storage element 14 and the parasitic capacitor 20 form a circuit loop with the metal body 11 and the antenna radiator 12, and the circuit loop may counteract the influence of the parasitic capacitor 20 on the antenna radiator 12, reduce the influence of the parasitic capacitor 20 on the antenna radiator 12 at an operating frequency band and improve the performance of the antenna radiator.

In an embodiment, the first energy storage element is a capacitor or an inductor.

In an embodiment, each of the at least one ground point is electrically connected to the antenna radiator through a wire stretched across the gap.

In an embodiment, there is a second energy storage element electrically connected between each of the at least one ground point and the antenna radiator.

In an embodiment, the position of the at least one ground point on the metal body is determined by the volume of the metal cover, the operating band of the antenna radiator and the capacitance value of the parasitic capacitor between the metal body and the antenna radiator.

In an embodiment, the second energy storage element is a capacitor or an inductor, and each ground point of the at least one ground point is electrically connected to one capacitor or one inductor.

Further structure of the metal cover will be described with reference to the following embodiments.

Thus, with the above metal cover provided by embodiments of the present disclosure, the influence of the parasitic capacitor on the antenna radiator 12 at certain frequency bands may be reduced and the performance of the antenna radiator is improved.

The technical solutions provided by the present disclosure will now be illustrated with reference to individual embodiments.

Figure 3:
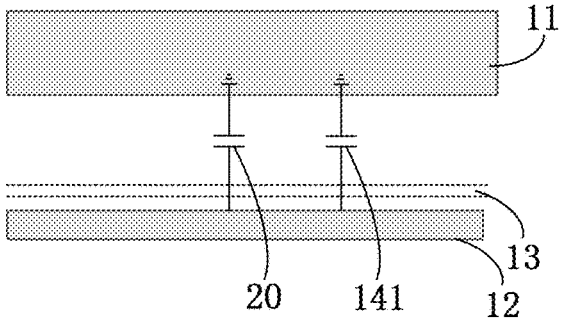
FIG. 3 is a schematic diagram showing an equivalent circuit of a metal cover according to another example embodiment.

FIG. 3 is a schematic diagram showing an equivalent circuit of a metal cover according to another example embodiment. In this embodiment, the above metal cover provided by embodiments of the present disclosure is utilized, and a capacitor 141 is used as an example of the first energy storage element 14 for exemplary illustration. As shown in FIG. 3, the capacitor 141 is electrically connected between the metal body 11 and the antenna radiator 12.

In an embodiment, Since the capacitance value of the parasitic capacitor 20 is depending on the size of the metal body 11, the opening(s) in the area where the antenna radiator 12 is located and on the like, when the volume of the metal body 11 and the opening(s) in the area where the antenna radiator 12 is located are designed, the range of the capacitance value of the parasitic capacitor 20 is determined, and then the capacitance value of the capacitor 141 is determined by the capacitance of the parasitic capacitor 20.

In this embodiment, by adding the capacitor 141 between the metal body 11 and antenna radiator 12, the capacitance value of the parasitic capacitor 20 may be changed, thus reducing the influence of the parasitic capacitor 20 on the operating band of the antenna radiator 12.

Figure 4:
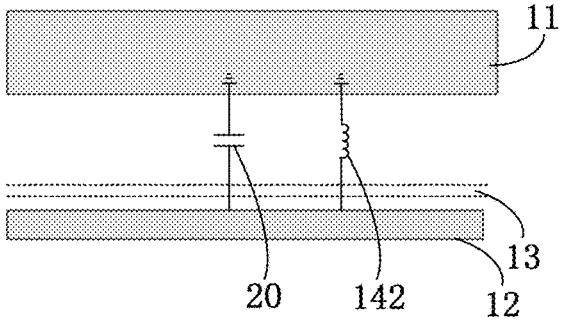
FIG. 4 is a schematic diagram showing an equivalent circuit of a metal cover according to yet another example embodiment.

FIG. 4 is a schematic diagram showing an equivalent circuit of a metal cover according to yet another example embodiment. In this embodiment, the above metal cover provided by embodiments of the present disclosure is utilized, and an inductor 142 is used as an example of the first energy storage element 14 for exemplary illustration. As shown in FIG. 4, the inductor 142 is electrically connected between the metal body 11 and the antenna radiator 12.

Similar to the above embodiment in FIG. 3, the capacitance value of the parasitic capacitor 20 is depending on the size of the metal body 11 and the opening(s) in the area where the antenna radiator 12 is located, and thus when the volume of the metal body 11 and the opening(s) in the area where the antenna radiator 12 is located are designed, the range of the capacitance value of the parasitic capacitor 20 is determined, and then the inductance value of the inductor 142 can be determined by the capacitance of the parasitic capacitor 20.

In this embodiment, by adding the inductor 142 between the metal body 11 and antenna radiator 12, the influence of the parasitic capacitor 20 on the operating band of the antenna radiator 12 can be counteracted through the inductor 142.

Figure 5:
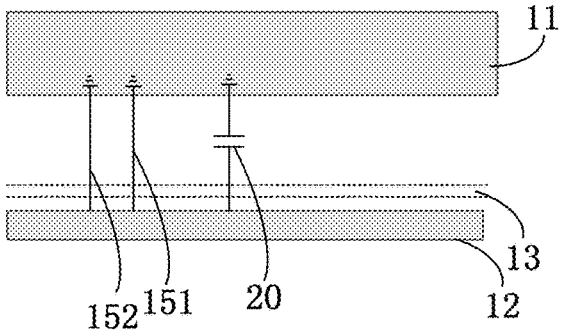
FIG. 5 is a schematic diagram showing an equivalent circuit of a metal cover according to yet another example embodiment.

FIG. 5 is a schematic diagram showing an equivalent circuit of a metal cover according to yet another example embodiment. In this embodiment, the above metal cover provided by embodiments of the present disclosure is utilized, and the metal body 11 having at least one ground point provided thereon is used as an example for exemplary illustration. As shown in FIG. 5, there are at least one ground points provided on the metal body 11. FIG. 5 shows two ground points and the corresponding wire 151 and wire 152, that is, the wire 151 and the wire 152 are connected between the antenna radiator 12 and the metal body 11, and both the wire 151 and the wire 152 are across the gap 13.

In an embodiment, the position of the ground points of the wire 151 and the wire 152 on the metal body 11 is determined by the volume of the metal cover, the operating band of the antenna radiator 12 and the capacitance value of the parasitic capacitor between the metal body 11 and the antenna radiator 12. In another embodiment, the position of the ground points of the wire 151 and the wire 152 on the metal body 11 may be determined after the debugging of the electronic device.

In the structure of the metal cover of this embodiment, with the parallel connection of the wire 151 and the wire 152, and with the circuit loop formed by the wire 51, the wire 52, the metal body 11 and the antenna radiator 12, the influence of the parasitic capacitor 20 on the antenna radiator 12 in the operating band can be changed.

Figure 6:
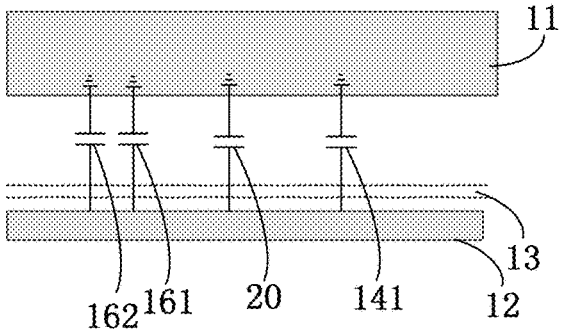
FIG. 6 is a schematic diagram showing an equivalent circuit of a metal cover according to yet another example embodiment.

FIG. 6 is a schematic diagram showing an equivalent circuit of a metal cover according to yet another example embodiment. In this embodiment, the above metal cover provided by embodiments of the present disclosure is utilized, and a capacitor 161 and a capacitor 162 are used as an example of the second energy storage element for exemplary illustration. As shown in FIG. 6, there are also ground points corresponding to the capacitor 161 and the capacitor 162 on the metal body 11, and the capacitor 161 and the capacitor 162 are electrically connected to the corresponding ground points respectively.

In an embodiment, the ground points on the metal body 11 may be connected to the metal body 11 by means of elastic slices. In an embodiment, the capacitor 161 and the capacitor 162 may be electrically connected at the gap 13 directly.

In an embodiment, the position of the ground points corresponding to the capacitor 161 and the capacitor 162 on the metal body 11 is determined by the volume of the metal cover, the operating band of the antenna radiator 12 and the capacitance of the parasitic capacitor between the metal body 11 and the antenna radiator 12, or may be determined through experiments.

In the structure of the metal cover of this embodiment, with the parallel connection of the capacitor 141, the capacitor 161 and the capacitor 162, and with the circuit loop formed by the capacitor 141, the capacitor 161, the capacitor 162, the metal body 11 and the antenna radiator 12, the influence of the parasitic capacitor 20 on the antenna radiator 12 in the operating band can be changed.

Figure 7:
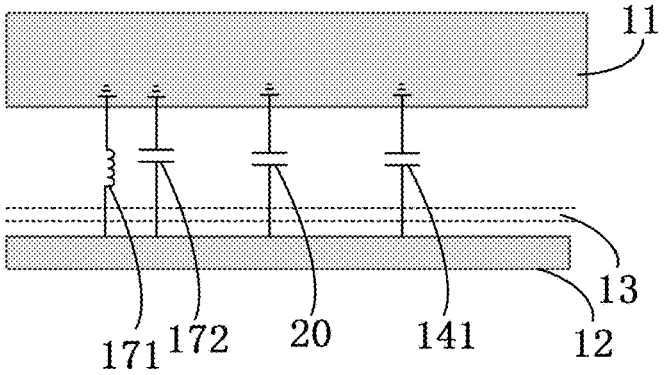
FIG. 7 is a schematic diagram showing an equivalent circuit of a metal cover according to yet another example embodiment.

FIG. 7 is a schematic diagram showing an equivalent circuit of a metal cover according to yet another example embodiment. In this embodiment, the above metal cover provided by embodiments of the present disclosure is utilized, and an inductor 171 and a capacitor 172 are used as an example of the second energy storage element for exemplary illustration. As shown in FIG. 7, there are also ground points corresponding to the inductor 171 and the capacitor 172 on the metal body 11, and the inductor 171 and the capacitor 172 are electrically connected to the corresponding ground points respectively.

In an embodiment, the ground points on the metal body 11 may be connected to the metal body 11 by means of elastic slices. In an embodiment, the inductor 171 and the capacitor 172 may be electrically connected at the gap 13 directly.

In an embodiment, the position of the ground points corresponding to the inductor 171 and the capacitor 172 on the metal body 11 is determined by the volume of the metal cover, the operating band of the antenna radiator 12 and the capacitance value of the parasitic capacitor between the metal body 11 and the antenna radiator 12, or may be determined through experiments.

In the structure of the metal cover of this embodiment, with the parallel connection of the capacitor 141, the inductor 171 and the capacitor 172, and with the circuit loop formed by the capacitor 141, the inductor 171, the capacitor 172, the metal body 11 and the antenna radiator 12, the influence of the parasitic capacitor 20 on the antenna radiator 12 in the operating band can be changed.

It should be understood by those skilled in the art that, the number of the ground points and the number of the inductors or capacitors shown in FIG. 2A to FIG. 7 are merely exemplary for illustration, and the number of inductors and/or capacitors and the number of the ground points shown in FIG. 2A to FIG. 7 shall not be constructed as any limits to the present disclosure. The number of inductors and/or capacitors and the number of ground points can be set according to actual requirements such as the volume of the electronic device, the size of the gap and opening(s), so as to eliminate the influence of the parasitic capacitor on the antenna radiator.

Figure 8:
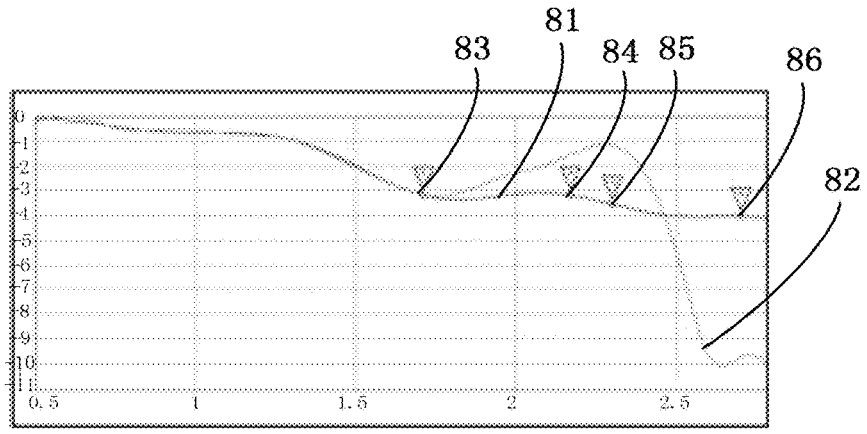
FIG. 8 is a schematic diagram showing performance curves of an antenna when the present disclosure is not used according to an example embodiment.
Figure 9:
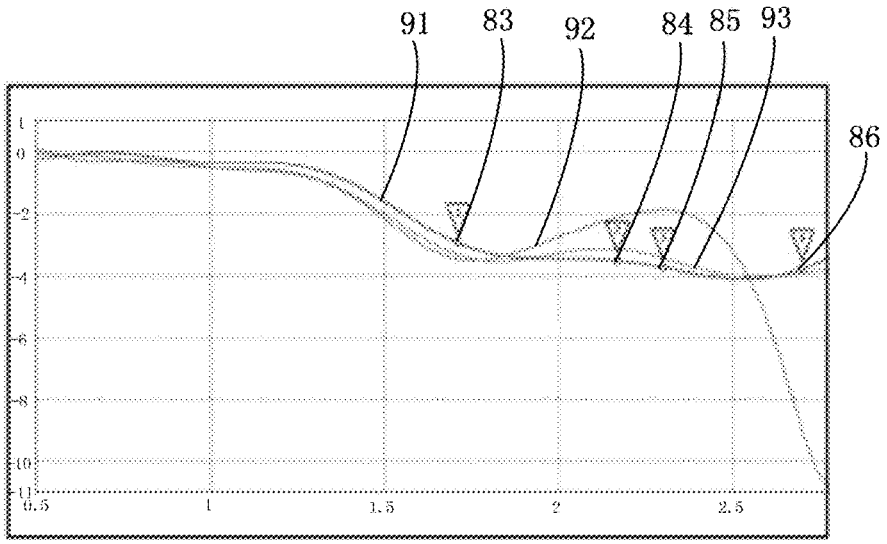
FIG. 9 is a schematic diagram showing performance curves of an antenna when the present disclosure is used according to an example embodiment.

FIG. 8 is a schematic diagram showing performance curves of the antenna when the present disclosure is not used according to an example embodiment. FIG. 9 is a schematic diagram showing performance curves of the antenna when the present disclosure is used according to an example embodiment. In the graphs shown in FIG. 8 and FIG. 9, the lateral axis represents the frequency, and the vertical axis represents the antenna return loss S11 (in DB). As shown in FIG. 8, when there is a USB interface 10 in an electronic device, and the wiring of the USB interface 10 stretches across the gap 13, the antenna return loss S11 in middle-frequency band bulges (shown as curve 82), and the radiating capability of the antenna drops clearly. Curve 81 shows a schematic view of the antenna efficiency when there is no USB interface in the electronic device. Reference number 83 corresponds to a frequency of 1710 MHz, reference number 84 corresponds to a frequency of 2170 MHz, reference number 85 corresponds to a frequency of 2300 MHz, and reference number 86 corresponds to a frequency of 2700 MHz.

When one ground point is added on the metal body 11 and the ground point is electrically connected to the antenna radiator 12 directly through a wire, the efficiency of the antenna is shown as the curve with reference number 91. The curve with reference number 93 schematically represents the efficiency of the antenna when there is no USB interface in the antenna radiator 12, and the curve with reference number 92 schematically represents the efficiency of the antenna when there is a USB interface in the antenna radiator 12 and the solutions according to the present disclosure are not used. It can be seen from FIG. 9 that, by adding one ground point on the metal body 11 and by electrically connecting the ground point to the antenna radiator 12 through a wire directly, the influence of the parasitic capacitor formed by the USB interface on the middle-frequency band can be eliminated. Those skilled in the art should understand that, FIG. 9 only shows advantageous effects corresponding to adding one ground point on the metal body 11, and by adding different number of ground points on the metal body 11, and by adding different combinations of capacitors and/or inductors between the ground points and the antenna radiator, influences of the parasitic capacitor on different frequency bands may be eliminated.

The influences on middle-frequency band signals are used as an example in the above embodiments. However, in some circumstances, because of the existence of the parasitic capacitor, the signals in high-frequency bands or low-frequency bands may also be influenced. By adding different number of ground points at different locations between the metal body 11 and the antenna radiator 12 and by loading different capacitors, inductors or direct short circuit at the ground points, the influences of the parasitic capacitor on different frequency bands may be eliminated.

Figure 10:
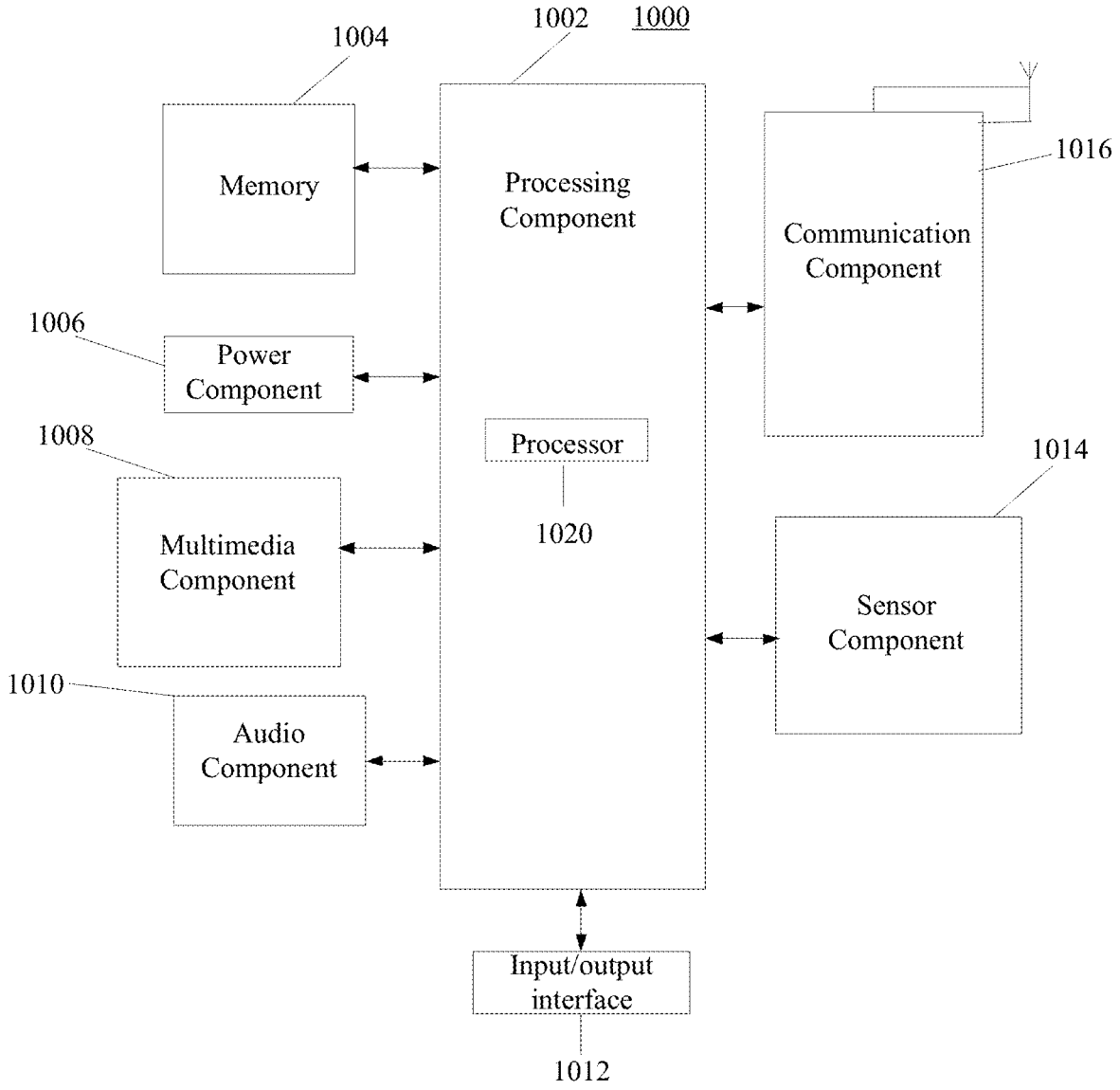
FIG. 10 is a block diagram showing an electronic device according to an example embodiment.

FIG. 10 is a block diagram showing an electronic device according to an example embodiment. For example, the device 1000 could be an electronic device such as a mobile phone having a camera, a computer, a digital broadcast terminal, a messaging device, a gaming console, a tablet, a medical device, an exercise equipment, a personal digital assistant and the like.

In detail, the electronic device includes a metal cover and the metal cover may be any one of the metal covers illustrated in above FIG. 2A to FIG. 7. The metal cover includes a metal body 11 and an antenna radiator 12, a gap 13 is formed between the metal body 11 and the antenna radiator 12, at least one ground point is provided on the metal body 11, and the antenna radiator 12 is electrically connected to at least one ground point.

In an embodiment, there is a first energy storage element electrically connected between the metal body 11 and the antenna radiator 12.

In an embodiment, a parameter of the first energy storage element is determined by a capacitance of the parasitic capacitor between the metal body and the antenna radiator.

With reference to FIG. 10, the device 1000 may include one or more of the following components: a processing component 1002, a memory 1004, a power component 1006, a multimedia component 1008, an audio component 1010, an input/output (I/O) interface 1010, a sensor component 1014, and a communication component 1016.

The processing component 1002 typically controls overall operations of the device 1000, such as the operations associated with display, telephone calls, data communications, camera operations, and recording operations. The processing component 1002 may include one or more processors 1020 to execute instructions to perform all or part of the steps in the above-described methods. Moreover, the processing component 1002 may include one or more modules which facilitate the interaction between the processing component 1002 and other components. For instance, the processing component 1002 may include a multimedia module to facilitate the interaction between the multimedia component 1008 and the processing component 1002.

The memory 1004 is configured to store various types of data to support the operation of the device 1000. Examples of such data include instructions for any applications or methods operated on the device 1000, contact data, phonebook data, messages, pictures, videos, etc. The memory 1004 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1006 provides power to various components of the device 1000. The power component 1006 may include a power management system, one or more power sources, and any other components associated with the generation, management, and distribution of power in the device 1000.

The multimedia component 1008 includes a screen providing an output interface between the device 1000 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1008 includes a front camera and/or a rear camera. The front camera and the rear camera may receive an external multimedia datum while the device 1000 is in an operation mode, such as a photographing mode or a video mode. Each of the front camera and the rear camera may be a fixed optical lens system or have focus and optical zoom capability.

The audio component 1010 is configured to output and/or input audio signals. For example, the audio component 1010 includes a microphone (MIC) configured to receive an external audio signal when the device 1000 is in an operation mode, such as a call mode, a recording mode, and a voice recognition mode. The received audio signal may be further stored in the memory 1004 or transmitted via the communication component 1016. In some embodiments, the audio component 1010 further includes a speaker to output audio signals.

The I/O interface 1010 provides an interface between the processing component 1002 and peripheral interface modules, such as a keyboard, a click wheel, buttons, and the like. The buttons may include, but are not limited to, a home button, a volume button, a starting button, and a locking button.

The sensor component 1014 includes one or more sensors to provide status assessments of various aspects of the device 1000. For instance, the sensor component 1014 may detect an open/closed status of the device 1000, relative positioning of components, e.g., the display and the keypad, of the device 1000, a change in position of the device 1000 or a component of the device 1000, a presence or absence of user contact with the device 1000, an orientation or an acceleration/deceleration of the device 1000, and a change in temperature of the device 1000. The sensor component 1014 may include a proximity sensor configured to detect the presence of nearby objects without any physical contact. The sensor component 1014 may also include a light sensor, such as a CMOS or CCD image sensor, for use in imaging applications. In some embodiments, the sensor component 1014 may also include an accelerometer sensor, a gyroscope sensor, a magnetic sensor, a pressure sensor, or a temperature sensor.

The communication component 1016 is configured to facilitate communication, wired or wirelessly, between the device 1000 and other devices. The device 1000 can access a wireless network based on a communication standard, such as WIFI, 2G, or 3G, or a combination thereof. In one exemplary embodiment, the communication component 1016 receives a broadcast signal or broadcast associated information from an external broadcast management system via a broadcast channel. In one exemplary embodiment, the communication component 1016 further includes a near field communication (NFC) module to facilitate short-range communications. For example, the NFC module may be implemented based on a radio frequency identification (RFID) technology, an infrared data association (IrDA) technology, an ultra-wide band (UWB) technology, a Bluetooth (BT) technology, and other technologies.

In exemplary embodiments, the device 1000 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components.

Other embodiments will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A metal cover, comprising:

a metal body comprising at least one ground point;

an antenna radiator electrically connected to the at least one ground point; and a gap formed between the metal body and the antenna radiator, wherein a first enemy storage element is electrically connected between the metal body and the antenna radiator, so as to reduce the influence of parasitic capacitors on the operating band of the antenna radiator, and the first enemy storage element is a capacitor; or each of the at least one around point is directly and electrically connected to the antenna radiator through a wire stretched across the gap.

2. The metal cover according to claim 1, wherein, a parameter of the first energy storage element is determined by a capacitance value of a parasitic capacitor between the metal body and the antenna radiator.

3. The metal cover according to claim 1, wherein, there is a second energy storage element electrically connected between each of the at least one ground point and the antenna radiator.

4. The metal cover according to claim 1, wherein, a position of the at least one ground point on the metal body is determined by:

a volume of the metal cover;

an operating band of the antenna radiator; and a capacitance value of a parasitic capacitor between the metal body and the antenna radiator.

5. The metal cover according to claim 3, wherein, the second energy storage element is a capacitor or an inductor, and each ground point of the at least one ground point is electrically connected to one capacitor or one inductor.

6. The metal cover according to claim 3, wherein, a position of the at least one ground point on the metal body is determined by:

a volume of the metal cover;

an operating band of the antenna radiator; and a capacitance value of a parasitic capacitor between the metal body and the antenna radiator.

7. An electronic device, comprising:

a processor;

a memory for storing instructions executable by the processor;

a metal cover, comprising:

a metal body comprising at least one ground point;

an antenna radiator electrically connected to the at least one ground point; and a gap formed between the metal body and the antenna radiator, wherein a first enemy storage element is electrically connected between the metal body and the antenna radiator, so as to reduce the influence of parasitic capacitors on the operating band of the antenna radiator, and the first enemy storage element is a capacitor; or each of the at least one ground point is directly and electrically connected to the antenna radiator through a wire stretched across the gap.

8. The electronic device according to claim 7, wherein, a parameter of the first energy storage element is determined by a capacitance value of a parasitic capacitor between the metal body and the antenna radiator.

9. The electronic device according to claim 7, wherein, there is a second energy storage element electrically connected between each of the at least one ground point and the antenna radiator.

10. The electronic device according to 7, wherein, a position of the at least one ground point on the metal body is determined by:

a volume of the metal cover;

an operating band of the antenna radiator; and a capacitance value of a parasitic capacitor between the metal body and the antenna radiator.

11. The electronic device according to claim 9, wherein, a position of the at least one ground point on the metal body is determined by:

a volume of the metal cover;

an operating band of the antenna radiator; and a capacitance value of a parasitic capacitor between the metal body and the antenna radiator.

12. The electronic device according to claim 9, wherein, the second energy storage element is a capacitor or an inductor, and each ground point of the at least one ground point is electrically connected to one capacitor or one inductor.

13. The metal cover according to claim 1, wherein the wire stretched across the gap is exactly connected between each of the at least one ground point and the antenna radiator.

14. The metal cover according to claim 1, wherein the metal cover comprises a plurality of wires connected in parallel and each stretched across the gap.

15. The metal cover according to claim 1, wherein a plurality of capacitors are electrically connected in parallel between the metal body and the antenna radiator.

16. The metal cover according to claim 1, wherein at least one capacitor and at least one inductor are electrically connected in parallel between the metal body and the antenna radiator.

17. The electronic device according to claim 7, wherein the wire stretched across the gap is exactly connected between each of the at least one ground point and the antenna radiator.

18. The electronic device according to claim 7, wherein the metal cover comprises a plurality of wires connected in parallel and each stretched across the gap.

19. The electronic device according to claim 7, wherein a plurality of capacitors are electrically connected in parallel between the metal body and the antenna radiator.

20. The electronic device according to claim 7, wherein at least one capacitor and at least one inductor are electrically connected in parallel between the metal body and the antenna radiator.

* * * * *